US008689697B2

(12) United States Patent
Notomi

(10) Patent No.: US 8,689,697 B2
(45) Date of Patent: Apr. 8, 2014

(54) SIMULATED FIREARM AND CARTRIDGE FOR SIMULATED FIREARM

(75) Inventor: Kikuo Notomi, Yokohama (JP)

(73) Assignee: Big Shot Co., Ltd., Kanagawa (JP)

( * ) Notice: Subject to any disclaimer, the term of this patent is extended or adjusted under 35 U.S.C. 154(b) by 121 days.

(21) Appl. No.: 13/511,136

(22) PCT Filed: Nov. 10, 2010

(86) PCT No.: PCT/JP2010/069986

§ 371 (c)(1),
(2), (4) Date: May 21, 2012

(87) PCT Pub. No.: WO2011/065225

PCT Pub. Date: Jun. 3, 2011

(65) Prior Publication Data

US 2012/0233900 A1 Sep. 20, 2012

(30) Foreign Application Priority Data

Nov. 26, 2009 (JP) ..... 2009 285670

(51) Int. Cl.
*F42B 8/00* (2006.01)

(52) U.S. Cl.
USPC ..... 102/444; 102/529; 102/430; 42/54

(58) Field of Classification Search
USPC ..... 42/54; 102/529, 355, 430, 444
See application file for complete search history.

(56) References Cited

U.S. PATENT DOCUMENTS 533,776 A 2/1895 Basnett
4,719,859 A * 1/1988 Ballreich et al. ..... 102/444
5,233,776 A * 8/1993 Hessey ..... 42/54
5,396,844 A * 3/1995 Hessey ..... 102/355
5,438,907 A 8/1995 Reynolds et al.
5,493,975 A 2/1996 Franzini et al.
6,189,454 B1 * 2/2001 Hunt ..... 102/444
6,971,314 B2 * 12/2005 Maguire ..... 102/430

(Continued)

FOREIGN PATENT DOCUMENTS

FR 2 379 041 A1 8/1978
JP 2002-162198 A 6/2002

OTHER PUBLICATIONS

International Search Report for the Application No. PCT/JP2010/069986 mailed Dec. 14, 2010.

*Primary Examiner* — Michael David

(74) *Attorney, Agent, or Firm* — Cheng Law Group, PLLC

(57) ABSTRACT

Provided is a cartridge for an electrically-ignited simulated firearm and a simulated firearm using the cartridge remarkably similar to a real firearm and a cartridge used in a real firearm, wherein the simulated firearm emits a discharge sound similar to a real firearm, generates muzzle flash and smoke from a muzzle and is capable of loading and ejecting the cartridge, and the cartridge is safe and reusable. An inner member 120 that is slidable inside an outer case 110 of a cartridge 100 and loaded with powder is formed into a stepped cylindrical shape with a small diameter section capable of partially projecting from an opening 112 of the outer case 110, and has a front powder chamber 122 and a rear powder chamber 123 that communicate with each other via a fuse hole 124, a base member 130 is formed to fit in the outer case 110 via an insulating member 131, and an ignition member 140 is configured to be installed between the inner member 120 and the base member 130.

7 Claims, 13 Drawing Sheets

(56) References Cited

U.S. PATENT DOCUMENTS 7,926,405 B2 * 4/2011 Ducastel, Jr. ..... 89/29
8,430,035 B2 * 4/2013 Ducastel, Jr. ..... 102/444
2005/0016410 A1 * 1/2005 Maguire ..... 102/430
2011/0016763 A1 * 1/2011 Ducastel, Jr. ..... 42/76.01

* cited by examiner

SIMULATED FIREARM AND CARTRIDGE FOR SIMULATED FIREARM

TECHNICAL FIELD

The present invention relates to a simulated firearm and a cartridge for a simulated firearm, more particularly to an electrically-ignited simulated firearm and a reusable cartridge used in a simulated firearm.

BACKGROUND ART

Conventional simulated firearms are manufactured to be remarkably similar to real firearms. In the case where simulated firearms are particularly used in films, dramas and theaters, it is highly desirable that the simulated firearms emit discharge sounds similar to real firearms, generate muzzle flash and smoke from firearm muzzles, and load and eject cartridges in addition to resembling in appearance in order that performances at the time of using the simulated firearms appear more authentic.

While all operations of simulated firearms are desired to be remarkably similar to real firearms, it is necessary that the simulated firearms have a structure not capable of live-firing because of safety aspects and regulations. In recent years, there are well-known electrically-ignited simulated firearms that safely emit discharge sounds similar to real firearms and generate muzzle flash and smoke from firearm muzzles.

For example, there is a known electrically-ignited simulated firearm in which multiple charge members loaded with powder are installed in a barrel, and the charge members are sequentially electrically ignited each time the trigger is pulled, so that muzzle flash and smoke are sequentially generated from a firearm muzzle while a discharge sound similar to a real firearm is emitted (for example, refer to Patent Document 1).

CITATION LIST

Patent Literature

Patent Document 1: U.S. Pat. No. 533,776 (whole pages and drawings)

SUMMARY OF THE INVENTION

Technical Problem

However, since the charge members used in the known electrically-ignited simulated firearm have a completely different shape from those used in a real firearm, the operation of loading and ejecting a cartridge cannot be imitated. In addition, there is a problem with a shape of the muzzle that is different from that of a real firearm.

The present invention has been made to solve the conventional problem described above. It is an object of the present invention to provide a cartridge for an electrically-ignited simulated firearm and a simulated firearm using the cartridge remarkably similar to a real firearm and a cartridge used in a real firearm, wherein the simulated firearm emits a discharge sound similar to a real firearm, generates muzzle flash and smoke from a firearm muzzle and is capable of loading and ejecting the cartridge, and the cartridge is safe and reusable.

Solution to Problem

The invention according to claim 1 is to solve the conventional problem by providing a cartridge for an electrically-ignited simulated firearm, including: a case body having an opening at least in a front portion and loaded with powder therein; an ignition member that electrically ignites the powder; and a base member installed in a rear portion of the case body to be electrically connected to the ignition member, wherein the case body is composed of an outer case formed into a hollow cylindrical shape, and an inner member slidable inside the outer case and loaded with the powder, the outer case has an opening in a front portion that stops the inner member from dropping from the outer case, and an engaging groove provided along a circumference in a rear portion thereof, the inner member is formed into a stepped cylindrical shape with a small diameter section capable of projecting from the opening of the outer case, and has a front powder chamber having an opening in a front portion and loaded with ejection powder and a rear powder chamber having an opening in a rear portion and loaded with propulsive powder, the front powder chamber and the rear powder chamber are formed to communicate with each other via a fuse hole, the base member is formed to fit in a rear end portion of the outer case via an insulating member, and the ignition member is installed between the inner member and the base member.

The invention according to claim 2 is to further solve the conventional problem by providing the cartridge for a simulated firearm according to claim 1, wherein the outer case is composed of a front case and a rear case that are detachably engaged with each other.

The invention according to claim 3 is to further solve the conventional problem by providing the cartridge for a simulated firearm according to claim 1 or 2, wherein the ignition member is composed of an insulating member and formed into a ring shape having a hollow, through which a heating element is provided while extending to both surfaces of the ignition member, and in which ignition powder is loaded.

The invention according to claim 4 is to further solve the conventional problem by providing the cartridge for a simulated firearm according to claim 4, wherein a metal plate composed of an electrical conductor having a diameter slightly larger than an inner diameter of the outer case is provided between the ignition member and the inner member to electrically connect the heating element of the ignition member with the outer case.

The invention according to claim 5 is to solve the conventional problem by providing an electrically-ignited simulated firearm capable of loading the cartridge for a simulated firearm according to any one of claims 1 to 4 provided in a rear portion of a barrel, including a bolt that slides and pushes the cartridge in a direction of the barrel, and capable of igniting powder in the cartridge by operating a trigger, wherein the barrel has a stopper that comes into contact with the cartridge on a tip side, and an ejection hole penetrating from the stopper to a tip of the barrel, and the bolt includes an engaging claw that engages with an engaging groove provided on an outer case of the cartridge, a penetration hole or a penetration groove to receive an ejector that loosely fits therein and comes into contact with a base of the cartridge when the cartridge moves backward, and a current supply member that supplies a current from the base member.

Advantageous Effects of the Invention

The cartridge for a simulated firearm according to claim 1 emits a discharge sound similar to a real firearm by applying a current to the base member from behind the cartridge to ignite the propulsive powder by the ignition member and also ignite the ejection powder through the fuse hole, generates muzzle flash and smoke similar to a real firearm by ejecting the ignited ejection powder from the front of the cartridge through the firearm muzzle of the simulated firearm, and generates a pressure to slide the inner member and the outer case by the propulsive powder, so that the cartridge moves backward for each ignition by the generated pressure and accordingly, the simulated firearm can eject the cartridge.

In addition, the outer case is remarkably similar to a real bullet so that the operation of loading and ejecting the cartridge is also remarkably similar to a real firearm.

The outer case is easily assembled due to the front case and the rear case that are detachably engaged with each other, and the cartridge after use is disassembled to be reused by refilling the inner member with powder.

According to the configuration of claim 2, the outer case is easily assembled due to the front case and the rear case that are detachably engaged with each other, and the cartridge after use is disassembled to be reused by refilling the inner member with powder.

According to the configuration of claim 3, a small amount of powder easily ignited can independently be put into the ignition member filled with the propulsive powder, so as to provide the safe propulsive powder and enhance safety at the time of assembling and reusing the cartridge.

According to the configuration of claim 4, even if dirt such as soot remains inside the outer case, the metal plate having a diameter larger than the inner diameter of the outer case is inserted into the outer case so as to ensure reliable conduction between the heating element and the outer case. Accordingly, the ignition member can ignite powder reliably, and ignition errors caused by lack of cleanup inside the outer case at the time of assembling and reusing the cartridge can be prevented.

The cartridge for the simulated firearm according to claim 5 emits a discharge sound similar to a real firearm by applying a current to the base member from behind the cartridge to ignite the propulsive powder by the ignition member and also ignite the ejection powder through the fuse hole, generates ignition and smoke similar to a real firearm by ejecting the ignited ejection powder from the front edge of the barrel through the ejection hole, retracts the bolt by moving the cartridge backward by the propulsive powder by bringing the inner member into contact with the stopper, and ejects the cartridge laterally on the engaging claw side by the ejector and the engaging claw after retracting the bolt, so that the operation of the simulated firearm is remarkably similar to a real firearm.

DETAILED DESCRIPTION OF THE INVENTION

Figure 1:
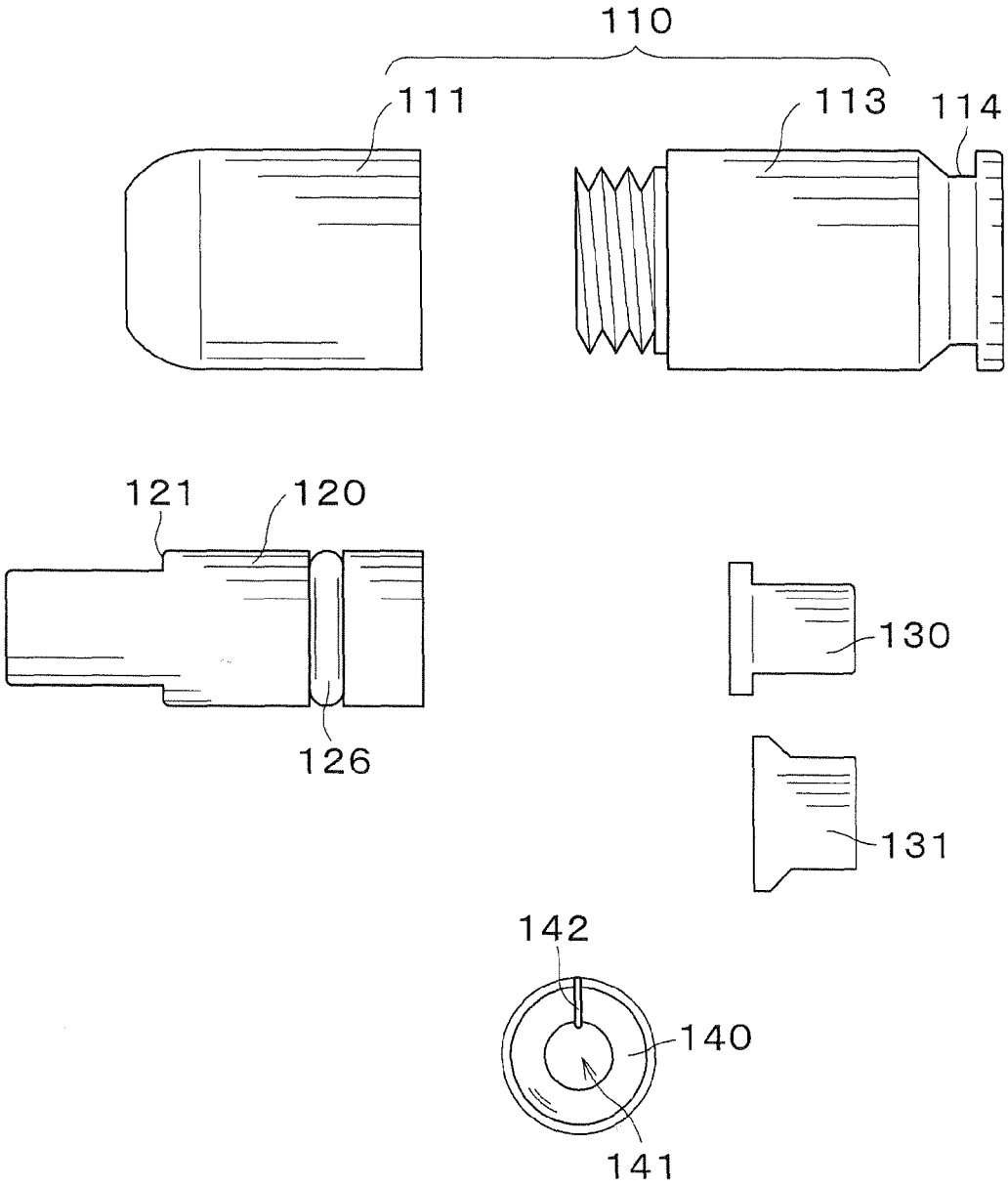
FIG. 1 is an exploded plan view of a cartridge for a simulated firearm of an embodiment of the present invention.

A cartridge for an electrically-ignited simulated firearm of the present invention includes a case body having an opening at least in the front portion and loaded with powder therein, an ignition member that electrically ignites powder, and a base member installed in a rear portion of the case body to be electrically connected to the ignition member. The case body is composed of an outer case formed into a hollow cylindrical shape, and an inner member slidable inside the outer case and loaded with powder. The outer case has an opening in the front portion that stops the inner member from dropping from the outer case, and an engaging groove provided in the rear portion along the circumference thereof. The inner member is formed into a stepped cylindrical shape with a small diameter section capable of projecting from the opening of the outer case, and has a front powder chamber having an opening in the front portion and loaded with ejection powder and a rear powder chamber having an opening in the rear portion and loaded with propulsive powder. The front powder chamber and the rear powder chamber are formed to communicate with each other via a fuse hole. The base member is formed to fit in a rear end portion of the outer case via an insulating member. The ignition member is configured to be installed between the inner member and the base member. A specific embodiment of the cartridge is not particularly limited as long as the cartridge can be used for an electrically-ignited simulated firearm, is remarkably similar to a cartridge used in a real firearm, emits a discharge sound similar to a real firearm, generates muzzle flash and smoke from the muzzle, can be loaded in and ejected from the simulated firearm, and is safe and reusable.

An electrically-ignited simulated firearm of the present invention is capable of loading the cartridge for a simulated firearm according to any one of claims 1 to 4 provided in the rear portion of a barrel of the simulated firearm, includes a bolt that slides and pushes the cartridge in the direction of the barrel, and is capable of igniting powder in the cartridge by operating a trigger. The barrel has a stopper that comes into contact with the cartridge on the tip side, and an ejection hole penetrating from the stopper to the tip of the barrel. The bolt includes an engaging claw that engages with an engaging groove provided on the outer case of the cartridge, a penetration hole or a penetration groove to receive an ejector that loosely fits therein and comes into contact with the base of the cartridge when the cartridge moves backward, and a current supply member that supplies a current from the base member. A specific embodiment of the simulated firearm is not particularly limited as long as the simulated firearm is remarkably similar to a real firearm, emits a discharge sound similar to a real firearm, generates muzzle flash and smoke from the muzzle, and is capable of loading and ejecting the cartridge.

EMBODIMENT

A description will be made below of a cartridge for a simulated firearm according to an embodiment of the present invention with reference to the drawings.

Figure 2:
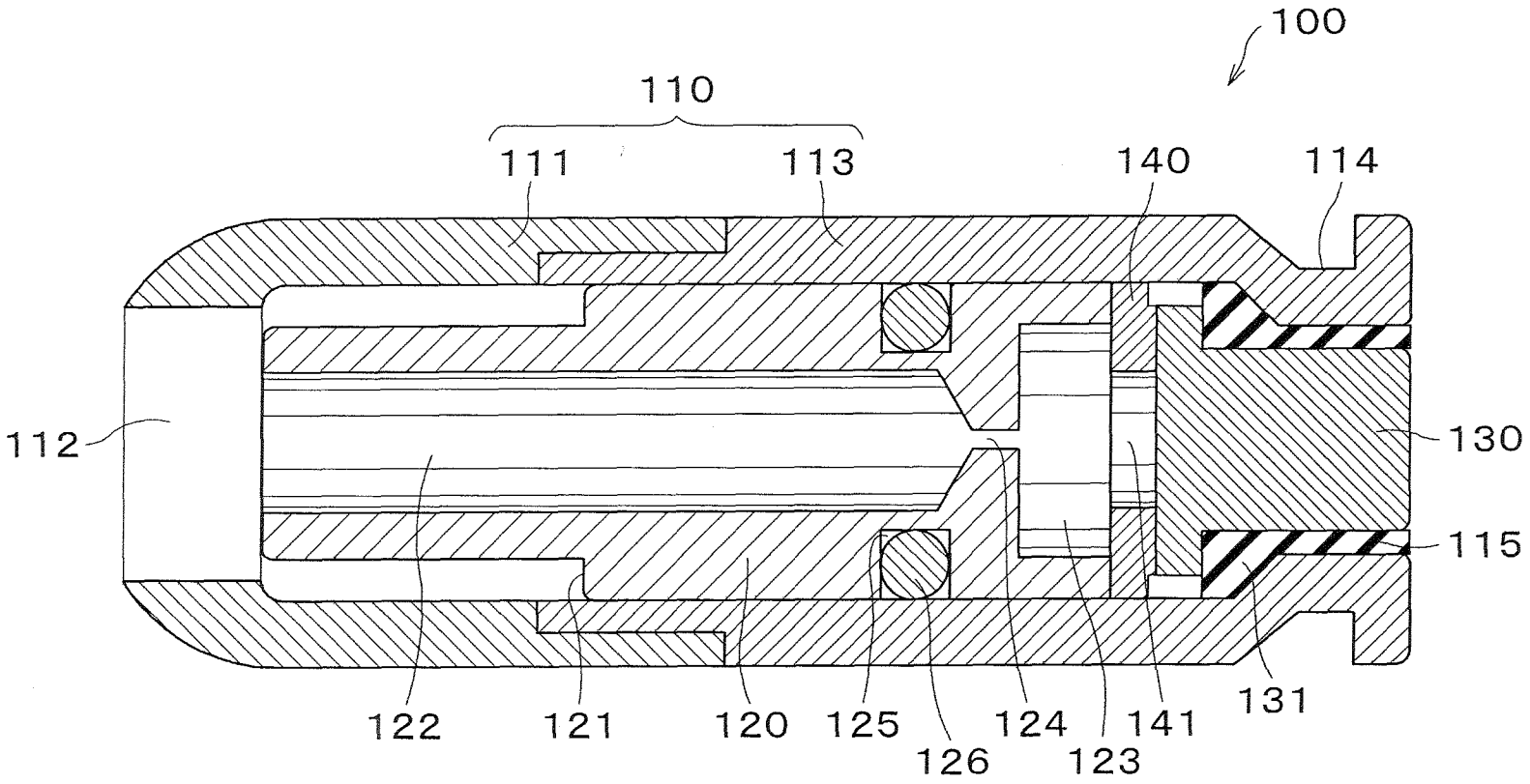
FIG. 2 is a cross-sectional assembly view of a cartridge for a simulated firearm of an embodiment of the present invention.

A cartridge 100 for a simulated firearm of the embodiment of the present invention includes an outer case 110 formed into a hollow cylindrical shape, and an inner member 120 slidable inside the outer case 110 and loaded with powder, as shown in FIG. 1 and FIG. 2.

The outer case 110 includes a front case 111 and a rear case 113 that are detachably engaged with each other by means of screw coupling. The front case 111 is provided with a diameter-reduced opening 112 in the front portion, and the rear case 113 is provided with a base diameter-reduced opening 115 in the rear portion and provided with an engaging groove 114 provided along the circumference thereof.

The inner member 120 is formed into a stepped cylindrical shape, in which a small diameter section capable of projecting from the opening 112 of the front case 111 is formed in a front portion of a stepped section 121 that is provided in the middle of the inner member 120 in a longitudinal direction, and a slidable large diameter section having approximately the same diameter as the inner diameter of the hollow outer case 110 is formed in a rear portion of the stepped section 121.

The front case 111 may be a short member only including the opening 112. In addition, the outer case 110 may be composed of an integrated member excluding the opening, and an additional member such as a pin may be detachably provided inward from the opening to lock the large diameter section of the inner member 120 to prevent from projecting.

The circumference of the large diameter section is provided with a circumferential groove 125 to which an O-ring 126 is attached. Therefore, it is not required to raise the accuracy of dimension of the inner member and the outer case. In addition, a pressure generated by the propulsive powder is kept inside so as to be fully used for sliding. Accordingly, the inner member and the outer case can be manufactured at a low cost. Further, even if the surface of the sliding part between the inner member and the outer case is damaged by ignition, only the inexpensive O-ring is needed to be replaced by a new ring for reuse. As a result, the frequency of reusing the cartridge can be increased.

The circumferential groove 125 and the O-ring may be provided as necessary.

The inner member 120 is provided with a front powder chamber 122 having an opening in the front portion and loaded with ejection powder and a rear powder chamber 123 having an opening in the rear portion and loaded with propulsive powder. The front powder chamber 122 and the rear powder chamber 123 are formed to communicate with each other via a fuse hole 124 having a small diameter.

A sliding amount of the inner member 120 in the outer case 110, that is, a length of the large diameter section, may be appropriately determined to the extent that the simulated firearm can load and eject the cartridge by use of a pressure of propulsive powder.

A base member 130 is formed to fit into the base diameter-reduced opening 115 provided in a rear portion of the rear case 113 via an insulating member 131. An ignition member 140 is installed and fixed between the inner member 120 and the base member 130.

Figure 3:
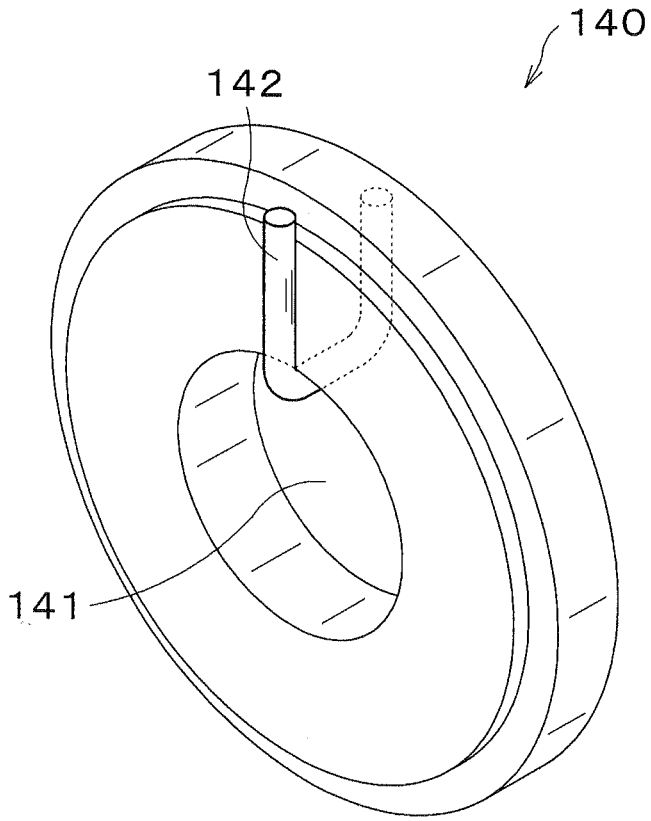
FIG. 3 is an enlarged perspective view of an ignition member of a cartridge for a simulated firearm of an embodiment of the present invention.

The ignition member 140 is composed of an insulating member and formed into a ring shape having a hollow 141. As shown in FIG. 3, a heating element 142 extending to both surfaces of the ignition member 140 is provided through the hollow 141, in which ignition powder is loaded.

The heating element 142 extends to the circumferential edge of the ignition member 140 on the front surface located when the ignition member 140 is installed, and extends in front of a stepped portion formed at the circumferential edge on the rear surface. In addition, an electrical circuit is formed from the base member 130 to the outer case 110 via the heating element 142 while being insulated by the insulating member 131.

Note that, the plural heating elements 142 may be provided in a radial direction as necessary in order to prevent ignition errors caused by disconnection or conductive defect.

Figure 12:
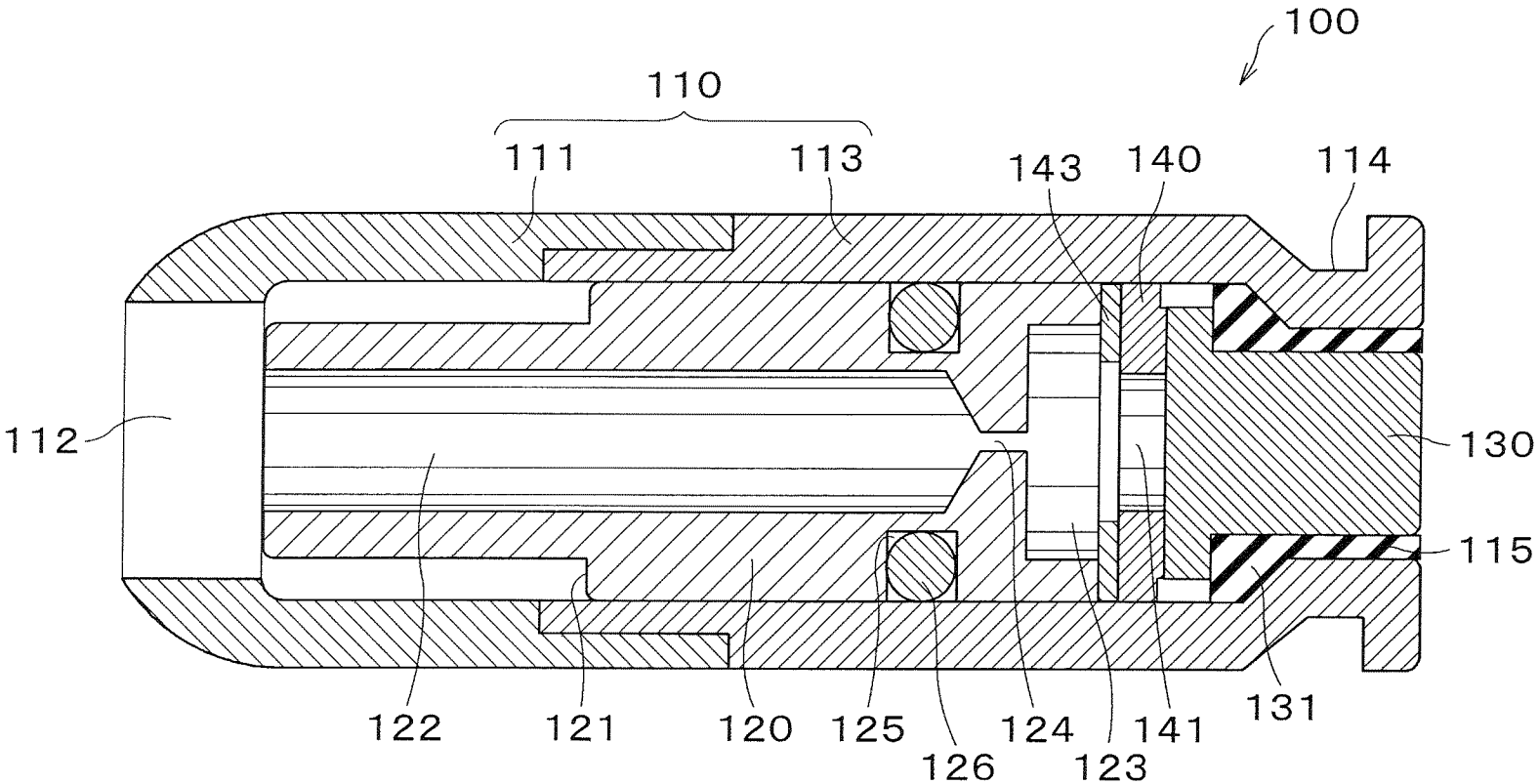
FIG. 12 is a cross-sectional assembly view of a cartridge for a simulated firearm of another embodiment of the present invention.
Figure 13:
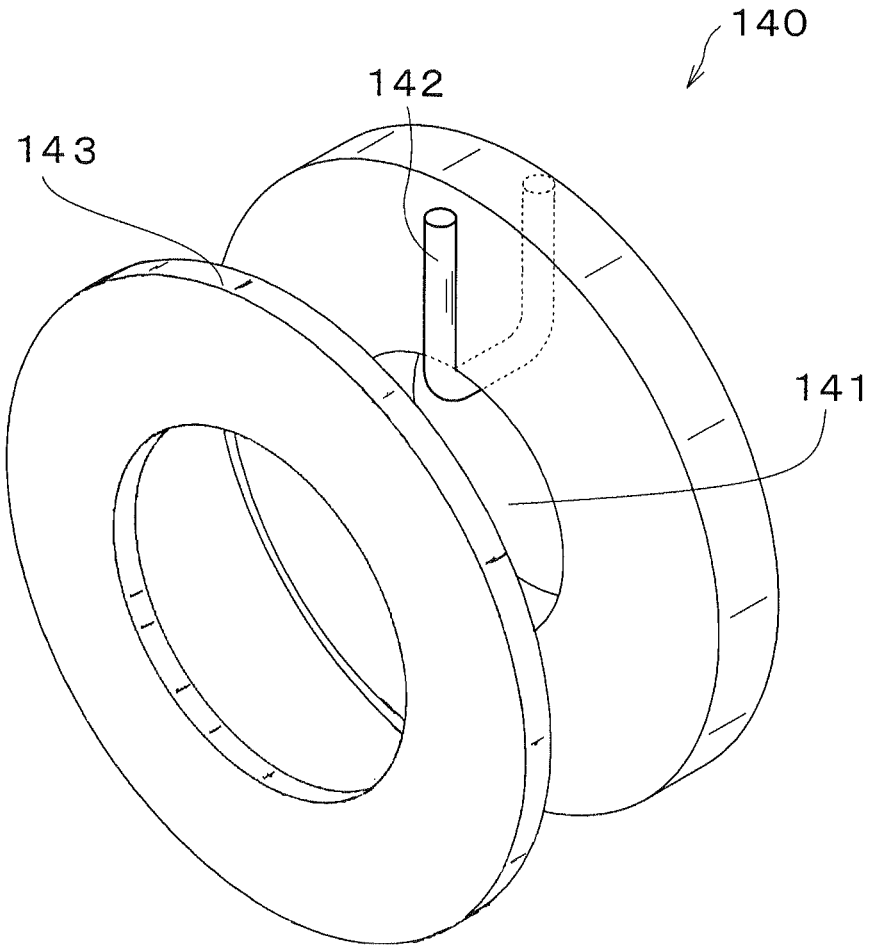
FIG. 13 is an enlarged perspective view of a metal plate of a cartridge for a simulated firearm of another embodiment of the present invention.

Alternatively, as shown in FIG. 12, in order to improve electrical conduction between the heating element 142 and the outer case 110 on the front side located when installing the ignition member 140, and to prevent ignition errors caused by lack of cleanup inside the outer case 110 at the time of assembling and reusing the cartridge, a thin metal plate 143 such as a copper plate having a diameter larger than the inner diameter of the outer case 110 may be installed between the ignition member 140 and the inner member 120 as shown in FIG. 13, so as to ensure reliable electrical conduction between the heating element 142 and the outer case 110.

Next, a description will be made below of a simulated firearm according to an embodiment of the present invention with reference to the drawings.

Figure 4:
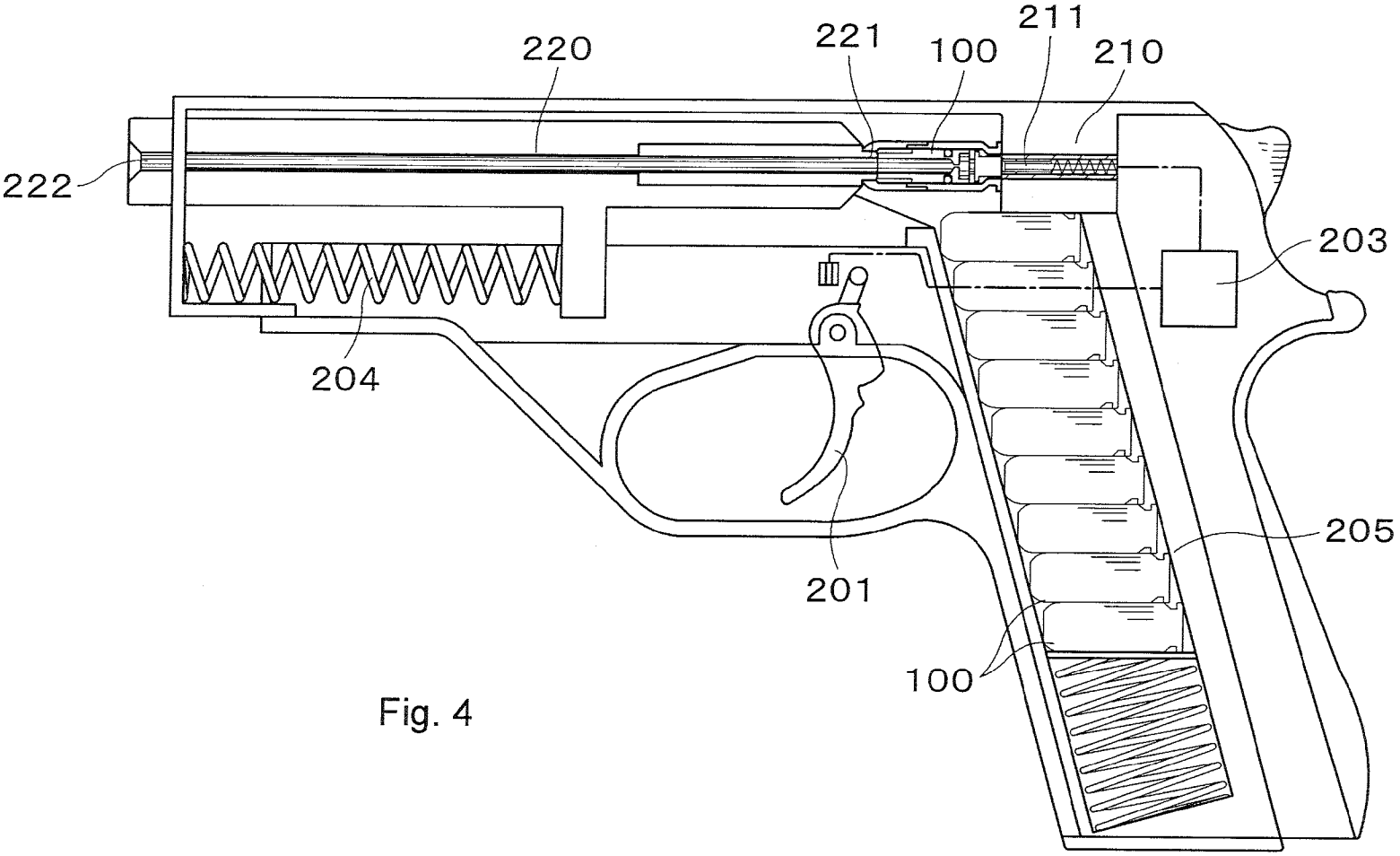
FIG. 4 is a partially exploded side view of a simulated firearm of an embodiment of the present invention.

A simulated firearm 200 of the embodiment of the present invention can load the cartridge 100 provided in a rear portion of a barrel 220, and includes a bolt 210 provided in a rear portion of the loaded cartridge 100, as shown in FIG. 4. The bolt 210 slides toward the barrel 220 by a pressing spring 204 to press the cartridge 100 to the barrel 220.

Figure 5:
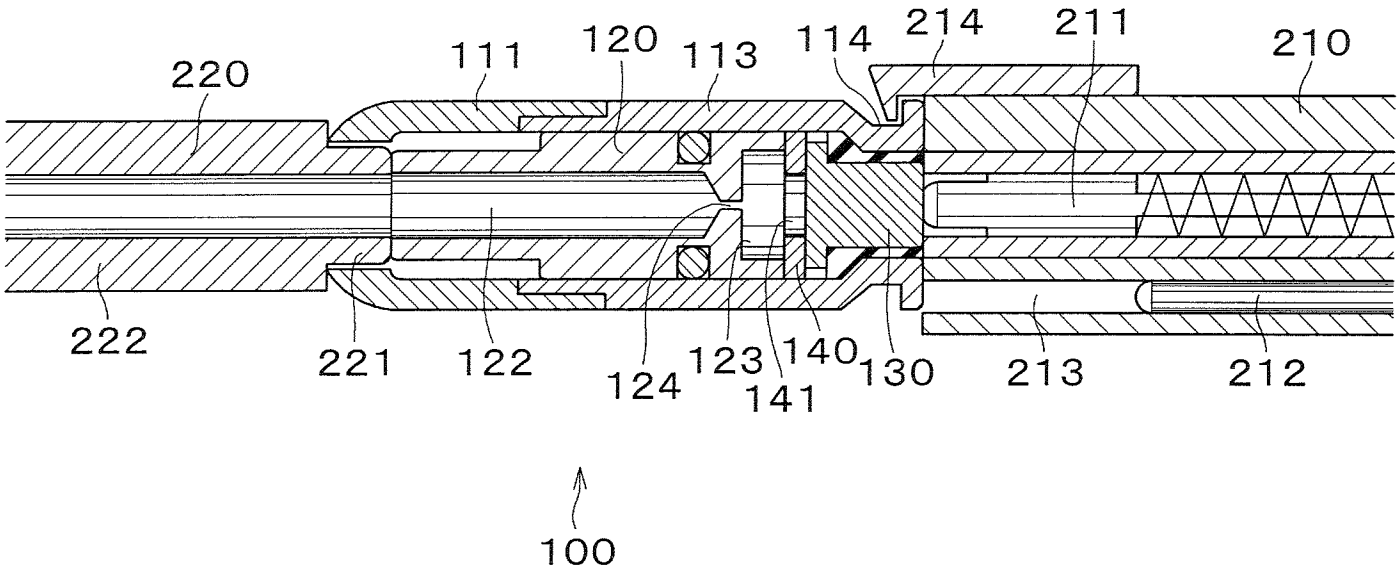
FIG. 5 is an explanatory view when a cartridge is loaded in a simulated firearm of an embodiment of the present invention.

As shown in FIG. 5, the barrel 220 includes a stopper 221 that comes into contact with the tip of the inner member 120 while passing through a diameter-reduced opening 112 provided in the front case 111 of the cartridge 100, and an ejection hole 222 penetrating from the stopper 221 to the tip of the barrel 220.

The bolt 210 includes an engaging claw 214 that engages with an engaging groove 114 provided in the rear case 113 of the cartridge 100, a penetration groove 213 to receive an ejector 212 that loosely fits therein and comes into contact with the base of the cartridge 100 when the cartridge 100 moves to slide the bolt 210 backward, and a current supply member 211 that comes into contact with the base member 130 of the cartridge 100, thereby applying a voltage.

The current supply member 211 is pushed toward the base of the cartridge 100 in the bolt 210, and controlled to slightly project from the bolt 210 by the stepped portion provided in the middle thereof when the cartridge 100 is not present.

The simulated firearm 200 is provided with a switch 202 that detects operations of a trigger 201, and a current generator 203 that receives signals from the switch 202 and applies voltage to the connecting member 211 so as to pass current necessary to detonate ignition powder.

Here, the simulated firearm 200 is configured in such a manner that the current generator 203 is mechanically or electrically supplied with only one signal from the switch 202 for each operation of the trigger 201, or the current generator 203 generates a current only once until the signal from the switch 202 is halted for a certain amount of time, so that a firing performance is not sequentially carried out while the trigger 201 is held continuously.

In addition, the simulated firearm 200 is provided with a magazine 205 that sequentially supplies a new cartridge from the bottom once the cartridge 100 is ejected laterally after detonating powder.

The following is a description of the operations of the simulated firearm 200 and the cartridge 100 for a simulated firearm configured as described above.

First, once a voltage is applied to the current supply member 211 when the cartridge 100 is loaded in the simulated firearm 200 as shown in FIG. 5, a current passes through the rear case 113 via the base member 130 and the heating element 142 of the ignition member 140, so as to ignite ignition powder loaded in the hollow 141 of the ignition member 140.

After the ignition powder is ignited, adjacent propulsive powder loaded in the rear powder chamber 123 of the inner member 120 is approximately immediately ignited, followed by ejection powder loaded in the front powder chamber 122 of the inner member 120 via the fuse hole 124, whereby a discharge sound similar to a real firearm is emitted.

Figure 6:
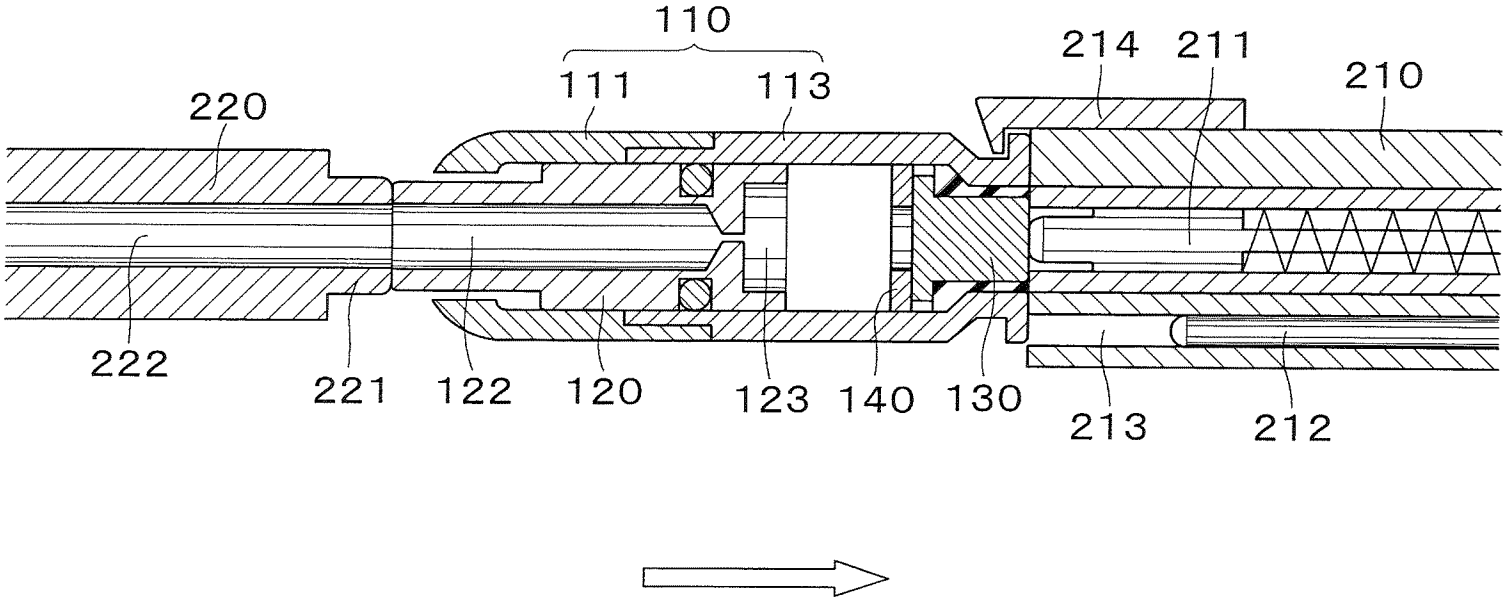
FIG. 6 is an explanatory view of an operation immediately after ignition of a simulated firearm and a cartridge of an embodiment of the present invention.

The ejection powder loaded in the front powder chamber 122 of the inner member 120 is ejected from the muzzle through the ejection hole 222 of the barrel 220 to generate muzzle flash and smoke similar to a real firearm. At the same time, as shown in FIG. 6, the cartridge 100 excluding the inner member 120 moves backward by a detonation pressure of the propulsive powder loaded in the rear powder chamber 123 of the inner member 120, thereby sliding the bolt 210 backward by a propulsive force of the cartridge 100 against a pressure of the pressing spring 204.

Figure 7:
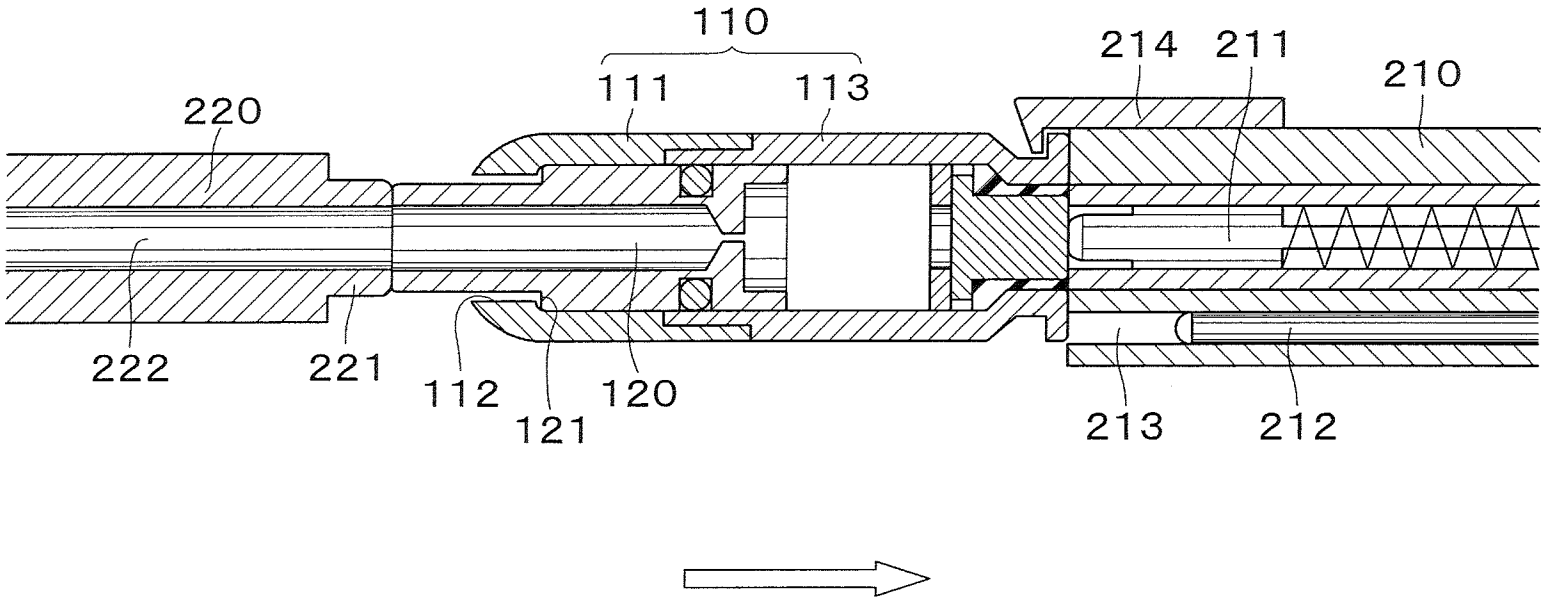
FIG. 7 is an explanatory view of an operation after the operation of FIG. 6.

Further, after the cartridge 100 excluding the inner member 120 moves backward, the stepped section 121 of the inner member 120 comes into contact with the diameter-reduced opening 112 of the front case 111 as shown in FIG. 7. Accordingly, the relative movement among the inner member 120 and the other members of the cartridge 100 other than the inner member 120 is completed.

However, the velocity of the cartridge 100 moving backward is still maintained while being decreased. Therefore, as shown in FIG. 8, the cartridge 100 including the inner member 120 still moves backward to further slide the bolt 210 backward.

Figure 8:
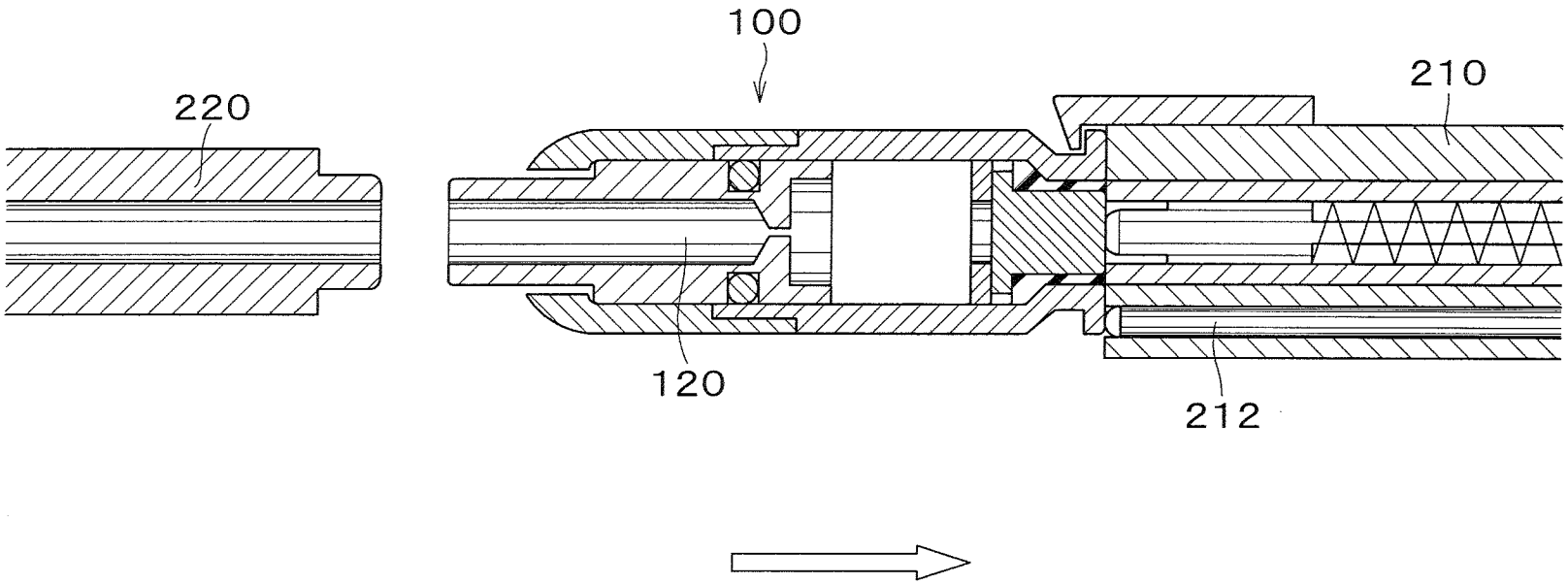
FIG. 8 is an explanatory view of an operation after the operation of FIG. 7.

Meanwhile, the ejector 212 that loosely fits in the penetration groove 213 of the bolt 210 is fixed independently of the bolt 210, and relatively comes closer to the base of the cartridge 100 and then into contact with the cartridge 100 in the sate of FIG. 8.

Figure 9:
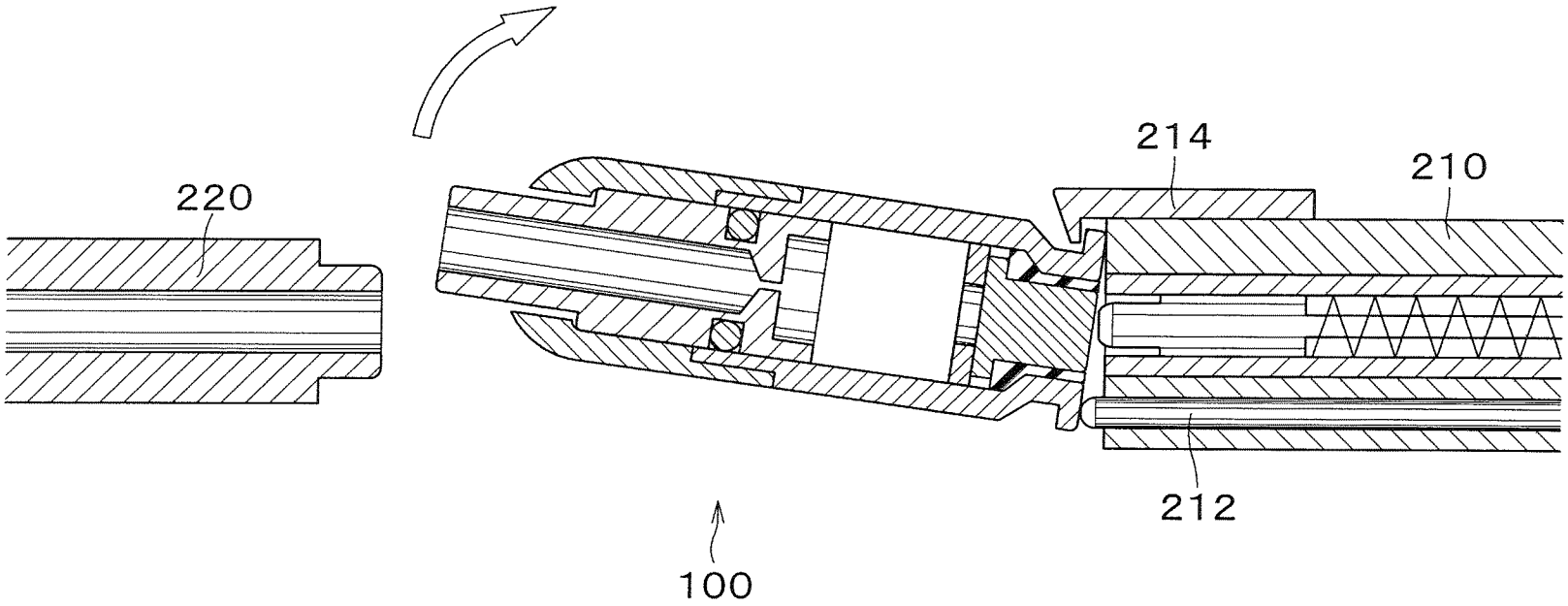
FIG. 9 is an explanatory view of an operation when a cartridge is ejected after the operation of FIG. 8.

After the cartridge 100 further moves backward, the ejector 212 projects on one side of the base of the cartridge 100 forward from the bolt 210 to prevent the cartridge 100 from further moving backward as shown in FIG. 9.

Meanwhile, the engaging claw 214 provided on the bolt 210 engages with the engaging groove 114 provided on the rear case 113 of the cartridge 100 while the velocity of the cartridge 100 moving backward is still maintained. Therefore, a rotation moment is generated with respect to the cartridge 100 on the engaging claw 214 side and accordingly, the cartridge 100 is ejected laterally.

After the cartridge 100 is ejected laterally, the bolt 210 slides and returns forward again from the state of sliding backward by a pressing force of the pressing spring 204. At this time, a new cartridge 100 moves upward from the magazine 205 located below as shown in FIG. 4. When the bolt 210 slides forward again due to the pressing spring 204, the cartridge 100 located at the top of the magazine 205 is pushed forward to be newly placed in the loading position as shown in FIG. 5. As a result, the firing performance can be repeated by operating the trigger 210.

As described above, the present invention can provide the electrically-ignited simulated firearm and the cartridge for a simulated firearm remarkably similar to a real firearm and a cartridge used for a real firearm, in which the simulated firearm can emit a discharge sound similar to a real firearm, generate muzzle flash and smoke from the muzzle, and load and eject the cartridge.

In addition, the cartridge 100 can be divided into several pieces. Therefore, the present invention can provide the cartridge for a simulated firearm that is reusable and thus economical by repeatedly loading powder in the inner member and the ignition member.

Note that, only the ignition member may be discarded after being used once because the ignition member is composed of an inexpensive material, a possibility of disconnection of the heating element per ignition is high, and explosiveness of ignition powder loaded in the hollow is high and thus the ignition powder is required to be treated cautiously.

In addition, the other components may also be discarded after being used once as long as there is no economical problem. In such a case, the outer case 110 may be composed of an integrated member excluding the opening, and the opening may be deformed inward so as to stop the large diameter section of the inner member 120 from projecting.

The cartridge for a simulated firearm of the present invention may be used for simulated firearms having other configurations other than the embodiment described above. For example, the cartridge of the present invention may be used for a so-called revolver-type simulated firearm having a cylinder, or may be used for a machine gun-type simulated firearm forcibly supplied with plural cartridges.

The cartridge for a simulated firearm of the present invention is reusable by repeatedly loading powder in the inner member. Therefore, in the case in which the cartridge of the present invention is used for a simulated firearm such as the revolver-type simulated firearm and the machine gun-type simulated firearm described above, which do not require ejection actions by a pressure of propulsive powder, it is possible to reduce the amount of propulsive powder and minimize explosive power.

Figure 10:
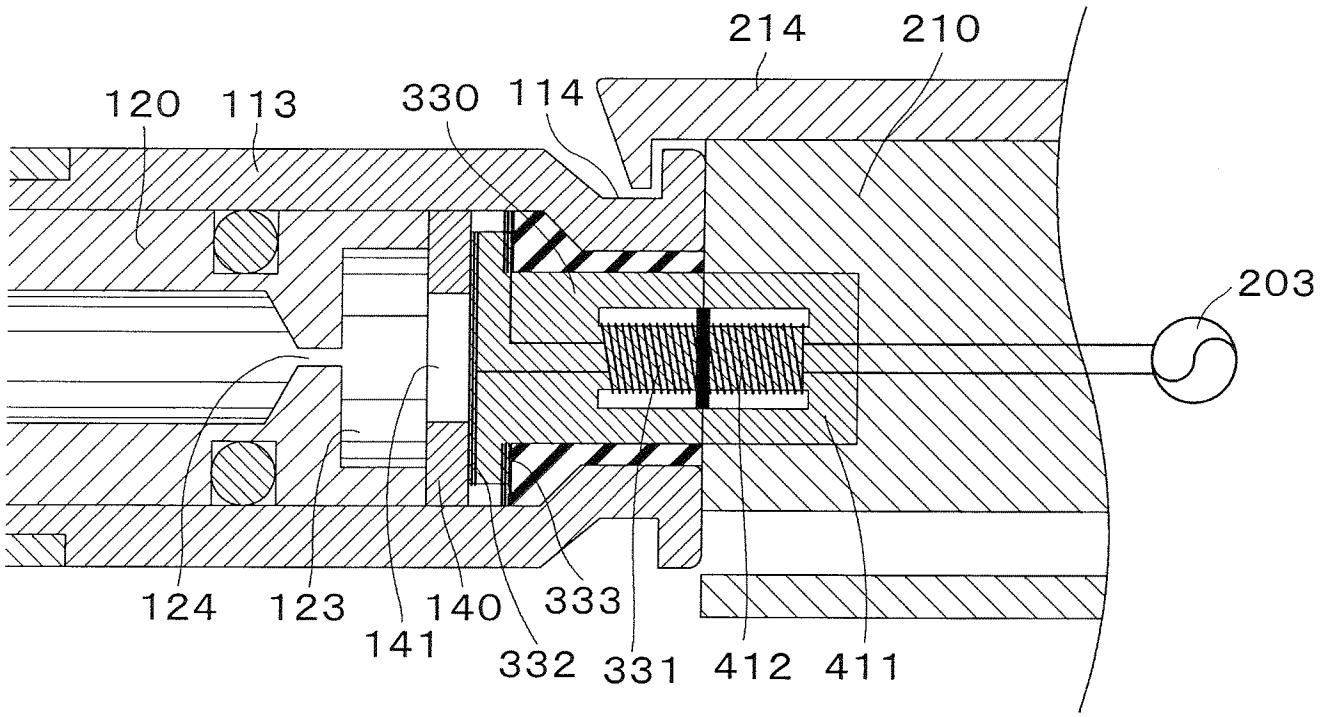
FIG. 10 is an enlarged explanatory view of a current-carrying part of a simulated firearm and a cartridge of another embodiment of the present invention.

A current supply to the ignition member 140 may be carried out, for example, by using a non-contact base member 330 having a receiving coil 331 wound on a ferrite core or an iron core provided at the base of the cartridge 100, and using a non-contact current supply member 411 having a feeding coil 412 wound on a ferrite core or an iron core provided in the bolt 210 of the simulated firearm 200 as shown in FIG. 10, in such a manner that a high-frequency AC is supplied to the feeding coil 412 from the current generator 203 to generate a current in the receiving coil 331 and supply the current from the bolt 210 to the cartridge 100 in the non-contact state.

One end of the conducting wire of the receiving coil 331 of the non-contact base member 330 is connected to a current-carrying plate 332 on the ignition member side, and the other end of the conducting wire is connected to a current-carrying plate 333 on the cartridge side. Thus, a current passes through the rear case 113 from the current-carrying plate 333 on the cartridge side via the heating element 142 of the ignition member 140 to ignite the ignition powder loaded in the hollow 141 of the ignition member 140.

Due to such a configuration, even if dirt such as soot is attached to the surfaces of the non-contact base member 330 and the non-contact current supply member 411 because of the ignition, a conductive defect is not caused. In addition, even in the case of the sequential firing operation, a firing defect is not caused so as to improve a maintenance performance.

Further, complete non-contact conduction may be applied by providing coiled wiring to the ignition member 140, providing coils on both sides of the non-contact base member 330, and completing current conducting paths inside the ignition member 140 and the base member 130, respectively. Accordingly, it is possible to improve a maintenance performance and reduce a firing operation defect.

According to the embodiment described above, the stopper 221 of the simulated firearm 200 is formed into a convex shape that comes into contact with the tip of the inner member 120 while passing through the opening 112 provided at the outer case 110 of the cartridge 100. However, the stopper 221 may be formed without a convex portion to come into contact with only the tip of the outer case 110. As a result, the inner member 120 moves forward to a certain extent by ignition of powder and then comes into contact with the stopper 221 so that the cartridge 100 moves the bolt backward.

Figure 11:
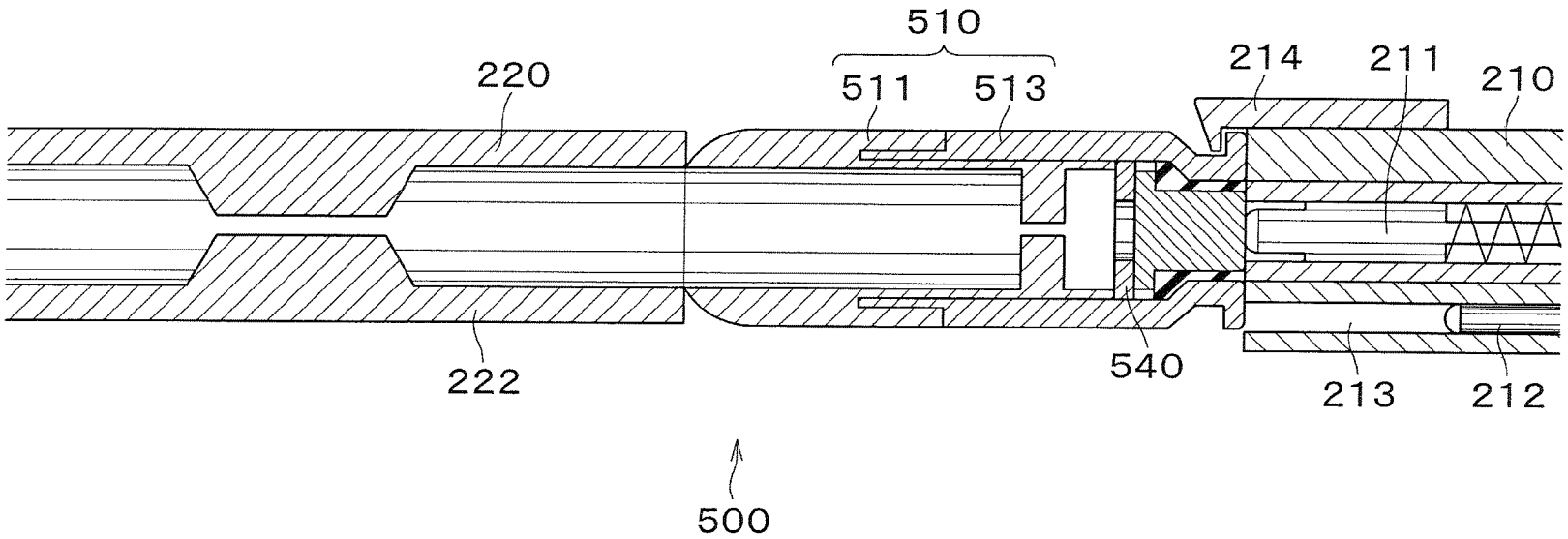
FIG. 11 is an enlarged explanatory view of a stopper of a simulated firearm and a cartridge of another embodiment of the present invention.

In addition, the present invention can provide an electrically-ignited simulated firearm and a cartridge for a simulated firearm as shown in FIG. 11, in which a cartridge 500 is not provided with an inner member but provided with a front case 511 of an outer case 510 that extends to the inside of an rear case 513 to push an ignition member 540, the front case 511 is loaded with powder, and the simulated firearm is provided with a small diameter section in the middle of the ejection hole, so that the cartridge 500 can move the bolt backward by use of part of ejection pressure of powder ejected forward from the ejection hole of the simulated firearm, and the simulated firearm can load and eject the cartridge in the same manner as described above.

REFERENCE SIGNS LIST

100 Cartridge
110 Outer case
111 Front case
112 Diameter-reduced opening
113 Rear case
114 Engaging groove
115 Base diameter-reduced opening
120 Inner member
121 Stepped section
122 Front powder chamber
123 Rear powder chamber
124 Fuse hole
125 Circumferential groove
126 O-ring
130 Base member
131 Insulating member
140 Ignition member
141 Hollow
142 Heating element
143 Metal plate
200 Simulated firearm
201 Trigger
202 Switch
203 Current generator
204 Pressing spring
205 Magazine
210 Bolt
211 Current supply member
212 Ejector
213 Penetration groove
214 Engaging claw
220 Barrel
221 Stopper
222 Ejection hole
330 Non-contact base member
331 Receiving coil
332 Current-carrying plate on ignition member side
333 Current-carrying plate on cartridge side
411 Non-contact current supply member
412 Feeding coil
500 Cartridge (no inner member type)
510 Outer case

The invention claimed is:

1. A cartridge for an electrically-ignited simulated firearm, comprising:

a case body having an opening at least in a front portion and loaded with powder therein;

an ignition member that electrically ignites the powder; and a base member installed in a rear portion of the case body to be electrically connected to the ignition member, wherein the case body is composed of an outer case formed into a hollow cylindrical shape, and an inner member slidable inside the outer case and loaded with the powder, the outer case has an opening in a front portion that stops the inner member from dropping from the outer case, and an engaging groove provided along a circumference in a rear portion thereof, the inner member is formed into a stepped cylindrical shape with a small diameter section capable of projecting from the opening of the outer case, and has a front powder chamber having an opening in a front portion and loaded with ejection powder and a rear powder chamber having an opening in a rear portion and loaded with propulsive powder, the front powder chamber and the rear powder chamber are formed to communicate with each other via a fuse hole, the base member is formed to fit in a rear end portion of the outer case via an insulating member, and the ignition member is installed between the inner member and the base member.

2. The cartridge for a simulated firearm according to claim 1, wherein the outer case is composed of a front case and a rear case that are detachably engaged with each other.

3. The cartridge for a simulated firearm according to claim 1, wherein the ignition member is composed of an insulating member and formed into a ring shape having a hollow, through which a heating element is provided while extending to both surfaces of the ignition member, and in which ignition powder is loaded.

4. The cartridge for a simulated firearm according to claim 3, wherein an auxiliary conductive plate composed of an electrical conductor having a diameter slightly larger than an inner diameter of the outer case is provided between the ignition member and the inner member to electrically connect the heating element of the ignition member with the outer case.

5. An electrically-ignited simulated firearm capable of loading the cartridge for a simulated firearm according to claim 1 provided in a rear portion of a barrel, including a bolt that slides and pushes the cartridge in a direction of the barrel, and capable of igniting powder in the cartridge by operating a trigger, wherein the barrel has a stopper that comes into contact with the cartridge on a tip side, and an ejection hole penetrating from the stopper to a tip of the barrel, and the bolt includes an engaging claw that engages with an engaging groove provided on an outer case of the cartridge, a penetration hole or a penetration groove to receive an ejector that loosely fits therein and comes into contact with a base of the cartridge when the cartridge moves backward, and a current supply member that supplies a current from the base member.

6. The cartridge for a simulated firearm according to claim 2, wherein the ignition member is composed of an insulating member and formed into a ring shape having a hollow, through which a heating element is provided while extending to both surfaces of the ignition member, and in which ignition powder is loaded.

7. The cartridge for a simulated firearm according to claim 6, wherein an auxiliary conductive plate composed of an electrical conductor having a diameter slightly larger than an inner diameter of the outer case is provided between the ignition member and the inner member to electrically connect the heating element of the ignition member with the outer case.

* * * * *